United States Patent [19]

Tapscott et al.

[11] Patent Number: 5,056,602

[45] Date of Patent: Oct. 15, 1991

[54] COPPER POWDER FIRE EXTINGUISHANT

[75] Inventors: Robert E. Tapscott, Albuquerque, N. Mex.; Gregory A. Levcun, Poulsbo, Wash.

[73] Assignee: University of New Mexico, Albuquerque, N. Mex.

[21] Appl. No.: 452,485

[22] Filed: Dec. 19, 1989

[51] Int. Cl.[5] ..... A62C 3/00

[52] U.S. Cl. ..... 169/46; 169/47; 252/002

[58] Field of Search ..... 169/43, 46, 47; 252/2, 252/601

[56] References Cited

U.S. PATENT DOCUMENTS

| | | | |
|---|---|---|---|
| 2,880,172 | 3/1959 | McCutchan | 252/2 |
| 3,840,075 | 10/1974 | Schmitt | 169/43 |
| 4,481,119 | 11/1984 | Rhein et al. | 169/46 |

FOREIGN PATENT DOCUMENTS

| | | | |
|---|---|---|---|
| 919684 | 4/1982 | U.S.S.R. | 252/2 |

*Primary Examiner*—Sherman Basinger
*Assistant Examiner*—Stephen P. Avila
*Attorney, Agent, or Firm*—Albert Sopp

[57] ABSTRACT

An arrangement is provided for extinguishing burning metal or metal-involved fires by combining an extinguishant with the burning metal to form a resultant material. The resultant material may include an alloy and oxides of the burning material and the extinguishant and in any event forms a coating which is an adherent oxygen barrier. In one form of the invention, the extinguishant comprises mainly elemental copper in commercially available powder form. The extinguishant mixture may also include other material added to improve the deliverability, material flow, electrical resistance, moisture resistance or other characteristics.

38 Claims, 6 Drawing Sheets

COPPER POWDER FIRE EXTINGUISHANT

BACKGROUND OF THE INVENTION

The present invention was made in part with Government support under contract N 00253-89-M-3290 awarded by the Department of the Navy, and in part as a result of inventive contributions by the Department of the Navy. The United States Government has certain rights in this invention.

The present invention relates generally to the controlling and extinguishing of class D fires. Such fires generally involve the combustion of metallic substances such as are found in engines, electronic equipment, and other apparatus. Typically, the metals involved may include magnesium, lithium, aluminum, chromium, titanium, and other combustible metals. The fires may also involve mixtures of these metals with each other as well as with metal salts, with solid non-metallic (Class A) fuels, and/or with liquid hydrocarbon (Class B) fuels. An effective, general-use firefighting agent does not exist for metal fires including those involving the above metals. The present invention provides such an agent. As used herein, the terms "metal fire" or "metal-involved fire" includes fires involving the above-noted metals as well as mixtures of metals with metal salts, with solid non-metallic fuels, with liquid hydrocarbons, and with carbon.

Prior to the present invention the firefighting agents employed for metal fires have included gases, solids, and liquids. These substances work in one or more of the following ways to control or extinguish metal fires:

a. Isolate the fuel;
b. Isolate the oxidizer;
c. Dilute the oxidizer;
d. Cool the fuel.

Those skilled in this art will appreciate that the above methods are primarily physical. In one such mode, foams or blankets can be used to isolate and cool the fuel. Inert gases such as argon or nitrogen are relatively effective blankets which isolate and dilute the oxidizer. However, for metal fires in the presence of high winds or having high dynamics, gases are not very effective. Limitations also exist for water or $CO_2$ both of which contain oxygen and thus, at the high temperatures common in metal fires, provide an oxidant.

Regarding fires such as those involving magnesium, compounds such as silicon tetrafluoride, sulfur dioxide, and boron trifluoride have been used but often cause unwanted, vigorous, heat producing or explosive reactions with metals. Use of tricresyl phosphate or a solution of 7 to 9 percent by weight orthoboric acid in triethylene glycol can be somewhat more effective but produces secondary fires which require control with foam or water fog. Powders have also been employed with some success. For example, a mixture of potassium acid sulfate, trisodium phosphate, bauxite, and pumice forms a fused salt around a magnesium mass, thereby preventing contact with air. Another substance—hard pitch derived from coal tar—melts on contact with hot metal and forms a coating which excludes air. Alkali metal salts and graphite have also been employed with some success.

However, such solid agents are not very effective in reducing the temperature of the metal. In the absence of sufficient cooling, the metal can easily reignite if the fused layer is broken. One of the more effective powders for metal fires appears to be organic phosphate mixed with finely divided graphite. This is known as "G-1 Powder" made by The Fyr-Fyter Company. The phosphate absorbs the heat through vaporization, and the vapor excludes some air. The bulk of the cooling is accomplished through the high thermal conductivity of the graphite. Another powder, "MET-L-X Powder" made by Ansul Fire Protection, Inc., is fairly effective in some cases for horizontal and vertical Class D fires and consists of sodium chloride (86%) base with additives including tricalcium phosphate (1%) to improve powder flow, metal stearates (1%) to repel water, and a thermoplastic material (7%) to bind the sodium chloride particles together when applied to a fire. The sodium chloride melts to form an oxygen excluding barrier otherwise termed an adherent oxygen barrier. This product may be discharged from extinguishers propelled by $CO_2$ or nitrogen.

Iron filings have been used on magnesium fires but have not been particularly satisfactory because the rate of fire suppression is relatively slow. In some cases iron filings can cause intensification of the fire through adverse reactions with the burning material or fire products. An exhaustive list and discussion of commercially available materials and other substances including powders (solids), liquids, and gases for controlling or extinguishing metal fires, particularly for certain specific metals such as sodium or magnesium, can be found in Technical Report ESL-TR-86-17 entitled EXTINGUISHING AGENT FOR MAGNESIUM FIRE: PHASES I–IV, January, 1986, available from the Defense Technical Information Center, Cameron Station, Alexandria, Va. 22314.

None of the presently available substances is particularly effective in fighting metal fires, particularly larger fires involving the alkali metals including lithium and alkaline earth metals, and aluminum, chromium, titanium, and in some situations, carbon.

SUMMARY OF THE PRESENT INVENTION

In accordance with the present invention there is provided an arrangement for extinguishing metal fires by combining a metallic extinguishant with the burning metal to form a resulting, non-burning material. The resulting material may include an alloy and oxides of the burning metal and the extinguishant, and in any event forms a coating which is an adherent oxygen barrier. In one form of the invention there is provided an extinguishant comprised mainly of elemental copper which is commercially available in bulk powder form. The extinguishant may also contain a mixture of copper with other materials which do not contribute to the combustion or detract from the properties of the copper. The other materials improve properties such as deliverability, flow of the extinguishant, electrical resistance, moisture resistance, or other characteristics. The copper may also take the form of powder, pellets, shot, hollow spheres, ribbons, rods, grids, sheets, foils, or other configurations for application to metal fires such as burning lithium or other alkali metals, magnesium or other alkaline earth metals, aluminum, chromium, titanium, mixtures thereof, or to other combustible metals. The copper forms an alloy, compound, and/or mixture with the burning metal (the precise chemical nature or identity of the intermediate or resulting materials or substances is not yet completely understood or known), and in the process smothers the fire. It is believed that, because of its high thermal conductivity, the copper reduces the temperature of the burning metal, thus contributing to the effectiveness of the extingushing action of the copper. The material resulting from contact between the burning metal and copper forms a hardened substance. When used in particulate form such as powder, the copper particles may be coated with an electrically insulating material such as tetrafluoroethylene polymer to prevent interference by the copper with electrical equipment in the area of the fire. Such a polymer also has slippery characteristics, and when it is applied to the surface of each particle, reduces the coefficient of friction of the particles thereby facilitating dispensing from gas powered fire extinguishers.

BRIEF DESCRIPTION OF THE DRAWINGS

Reference is now made to the drawings in which like numerals refer to like parts and in which.

DESCRIPTION OF THE PREFERRED EMBODIMENT

Figure 1:
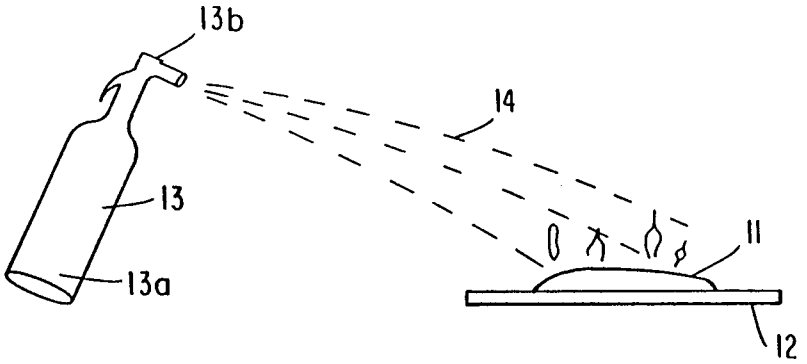
FIGS. 1, 2, 3, and 4 are schematic views of fire extinguishing arrangements in accordance with embodiments of the invention.

The fire extinguishing arrangement according to an embodiment of the present invention is shown in FIG. 1 where there is shown a burning body 11 which may be lithium or another alkali metal, an alkaline earth, or other combustible metal or substance located on a generally horizontal surface 12. A conventional fire extinguisher 13 powered by a compressed, preferably inert gas such as argon or helium (argon or nitrogen may also be used with somewhat less effectiveness) or by a mechanical mechanism of any suitable well known design is charged or loaded with particles or powder 14 of copper or of a material or composition containing copper. Preferably the material or composition contains a substantial percentage by weight of copper, e.g., preferably about 80% by weight of elemental copper as the extinguishant, with the remainder being constituted of other substances which do not materially affect the properties of the copper with respect to extinguishment.

The other materials may include graphite, metal stearates, and/or tri-calcium phosphate or other materials which, in the presence of a metal fire, do not materially contribute to the combustion or hamper the action of the extinguishant. These materials may be added to improve the qualities of the extinguishant such as: deliverability, flow, moisture resistance, electrical resistance (i.e., insulation), or other characteristics. For example, graphite may be present in amounts from about 1% to about 20% by weight of the fire extinguisher charge, metal stearates such as zinc or iron stearate from about 1% to about 8% by weight of the fire extinguisher charge, and tri-calcium phosphate from about 1% to about 10% by weight of the fire extinguisher charge. The powering gas in the extinguisher may be compressed to about 150 psi although other values in the range of from about 90 to about 220 psi may be used.

If desired, still other materials may be added to constitute the extinguishing composition or mixture. One may be polytetrafluoroethylene particles and/or coatings on the copper particles to improve electrical resistance, deliverability and flow. In such case the copper content by weight of the extinguisher charge could be reduced to about 40% with concomitant reduction in effectiveness of copper as the primary extinguishant.

When other materials are not added to the copper, the extinguishant should preferably contain about 95% by weight of elemental copper (e.g., copper of commercial grade purity—about 97% pure). As the percentage by weight of the copper is reduced, the less effective is the extinguishing action. However, reduction in percentage by weight of copper is tolerable and does not have a critical threshold value in terms of providing some extinguishment of metal fires so long as there is appreciable amount of copper present in relation to the size and intensity of the fire and so long as the other materials do not materially degrade the firefighting properties of the copper.

The powder particles 14 may be of any size or shape so long as they are of sufficiently small size and appropriate geometry to be propelled by the extinguisher 13. The extinguisher 13 may have a body portion 13*a* for storage of the extinguishant and a dispensing portion 13*b* for dispensing the extinguishant particles 14 and directing them to the burning material 11. Depending upon the amount and duration of discharge in relation to the intensity and dynamics of the fire, the result will be either total or partial extinguishment.

For lithium fires, extinguishment occurs with the formation of a copper lithium composition at essentially all surface areas of the fire. At the interface where the copper and lithium have had intimate physical contact at elevated temperatures, they may be in liquid state. At the interface, there typically exists molten lithium, lithium oxide, molten copper, copper oxide, and or copper/lithium compositions. In any event, at the interface there is a layer of all or some of the above materials which constitutes a coating or barrier to oxygen (i.e., an adherent oxygen barrier) at which extinguishment is occurring.

In some cases, small reignitions may occur following initial suppression by the extinguishant such as copper particles or powder because of the size or intensity of the fire compared with the amount of extinguishant applied. Obviously, as a practical matter—extinguishants containing higher percentages of copper are more effective, than extinguishants containing lower percentages. When extinguishing a fire it is usually impossible for operating personnel to know initially precisely how much extinguishant to use. Accordingly, additional quantities of extinguishant may need to be applied to hot or reignited spots to achieve total extinguishment.

Figure 2:
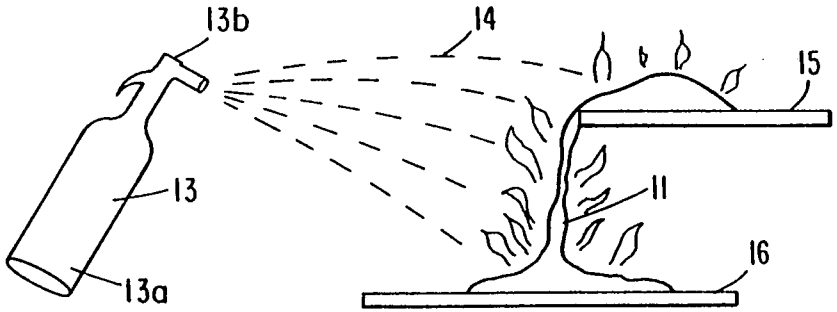

In FIG. 2 there is shown masses of liquid lithium or other combustible metal 11 burning and flowing from an elevated container or surface 15 to a lower container or surface 16. A fire extinguisher 13 is charged or loaded with particles or powder 14 containing substantial amounts of copper as the extinguishant, and the extinguishant is discharged from the extinguisher 13 onto the burning masses whereby, in accordance with the invention, an adherent oxygen barrier or layer or coating is formed thereon.

Figure 3:
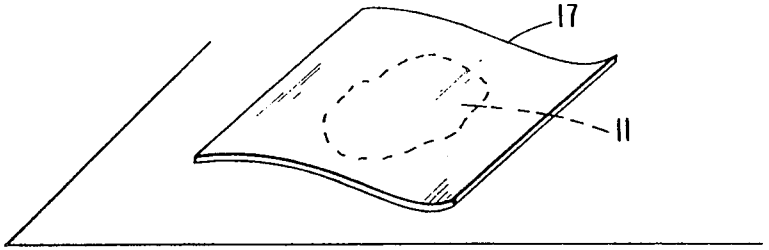

In FIG. 3, another arrangement is shown for extinguishing metal fires in accordance with the invention wherein a sheet or mat 17 containing at least some copper and preferably a substantial percentage of elemental copper is employed as the firefighting agent. The material comprising the remainder of the sheet or mat may be any or all of the above-described materials which do not detract from the fire extinguishing properties of the copper. The sheet or mat 17 is placed over the burning materials 11 with the result that there will be either total or partial extinguishment depending on size and mass of the copper compared with the size and intensity of the fire.

Figure 4:
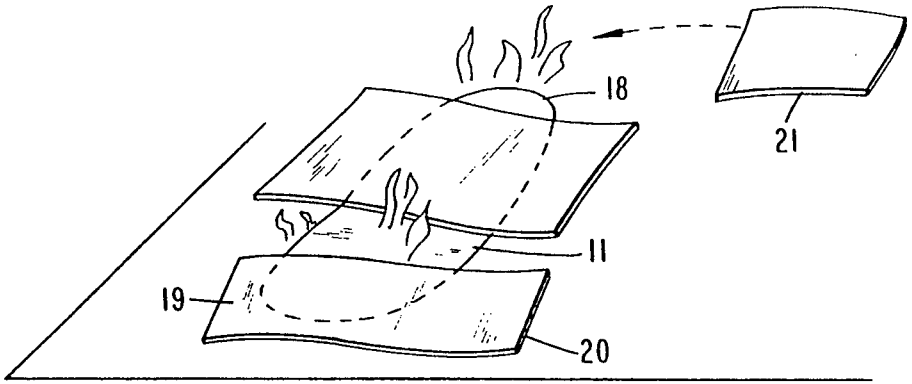

However, with the first application of the sheet or mat 17 of copper there may be some reiginited and edge burning areas 18 and some extinguished areas 19. Accordingly, as shown in FIG. 4, a second sheet or mat 20, or as many more sheets or mats 21 as are necessary, or other forms of copper such as powder, may be placed on or directed to the hot spots of the fire to achieve total extinguishment.

Figure 5:
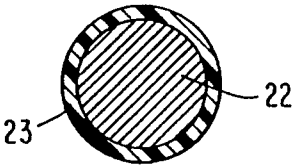
FIG. 5 is a view of a cross section of a particle of copper having an insulating coating thereon in accordance with an embodiment of the invention.

As shown in FIG. 5, the copper particles 22 may be coated with tetrafluoroethylene polymer, polyamide polymer, or any other suitable, well known electrically insulating, preferably slippery material 23 for easy dispensing from the fire extinguisher and, so that if moving air masses near the fire propel the particles into areas containing electrical equipment, the particles will not cause electrical short circuits, interference, or other problems. Other coatings such as shellac, varnish, or resins may be used. Of course, when the coated particles are close to or are in the flames, the coating quickly vaporizes, disintegrates, or decomposes leaving the metallic copper exposed to the burning alkali metal for interaction therewith.

As indicated in FIG. 2, the copper particles 31 will adhere to both the horizontal and vertical surfaces of the burning metal. The advantage of using copper particles such as copper in the form of powder or filings sized as low as 20 mesh or lower is to enable the copper to contact burning surfaces difficult to reach through the use of copper in other forms such as sheets or mats. However, depending on the nature of the fire, copper can be used in several forms and modes—sheets for one part of the fire, mats for another, grids for yet another, powder for another, etc., or any combination thereof.

The arrangement of the present invention is also effective in some fires involving carbon such as where carbon fibers, packets or other forms of carbon are employed in structures or bodies containing magnesium, aluminum, or chromium. The arrangement of the present invention may also be used for carbon fires where intensity and temperatures are high enough to ignite carbon such as in electrical generating plants where carbon is in the form of control rods used to control reactions.

Figure 6:
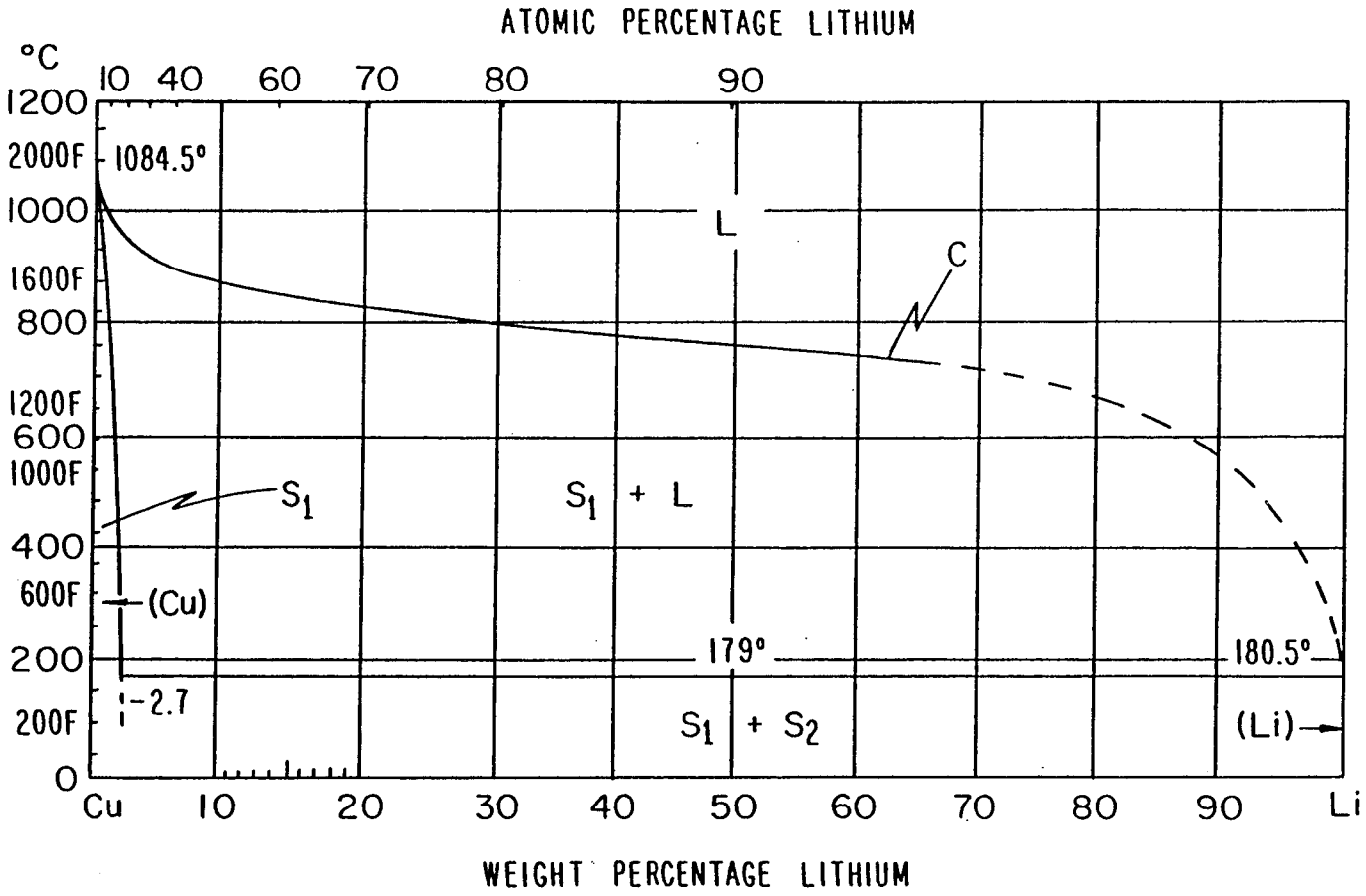
FIGS. 6 through 10 are phase diagrams indicating the temperatures at which copper and, respectively, lithium, magnesium, chromium, titanium, and aluminum change from liquid phases into mixed solid/liquid phases or solid phases.

Referring to the phase diagram of FIG. 6, the curve C indicates the temperatures where compositions of copper/lithium resulting from application of copper to a lithium fire pass from a liquid phase L to a mixture of liquid phase and solid phase $L+S_1$. To the far left of the diagram, a region containing the solid $S_1$, an alloy or solid solution of primarily copper with approximately 2% lithium, exists. If the percentage by weight of lithium is 10% and the balance is essentially copper, the solid phase $S_1$ mixed with or covering the liquid L will begin to appear as the temperature is lowered to about 870 degrees Celsius (about 1600 degrees Fahrenheit). If the percentage by weight of lithium is 70%, the alloy (solid solution $S_1$ mixed with the liquid L) will begin to form at about 700 degrees Celsius). Thus, the higher the percentage of copper by weight, the faster the fire will be extinguished due to the interaction of the copper with the lithium. The solid phase $S_1$, which forms readily over a substantial range of temperature, is believed to represent the primary coating material or layer formed as the adherent oxygen barrier to extinguish the fire. Below approximately 179 degrees Celsius, no liquid is present, and a mixture of two solid phases ($S_1+S_2$) exists over almost the entire range of compositions.

Figure 7:
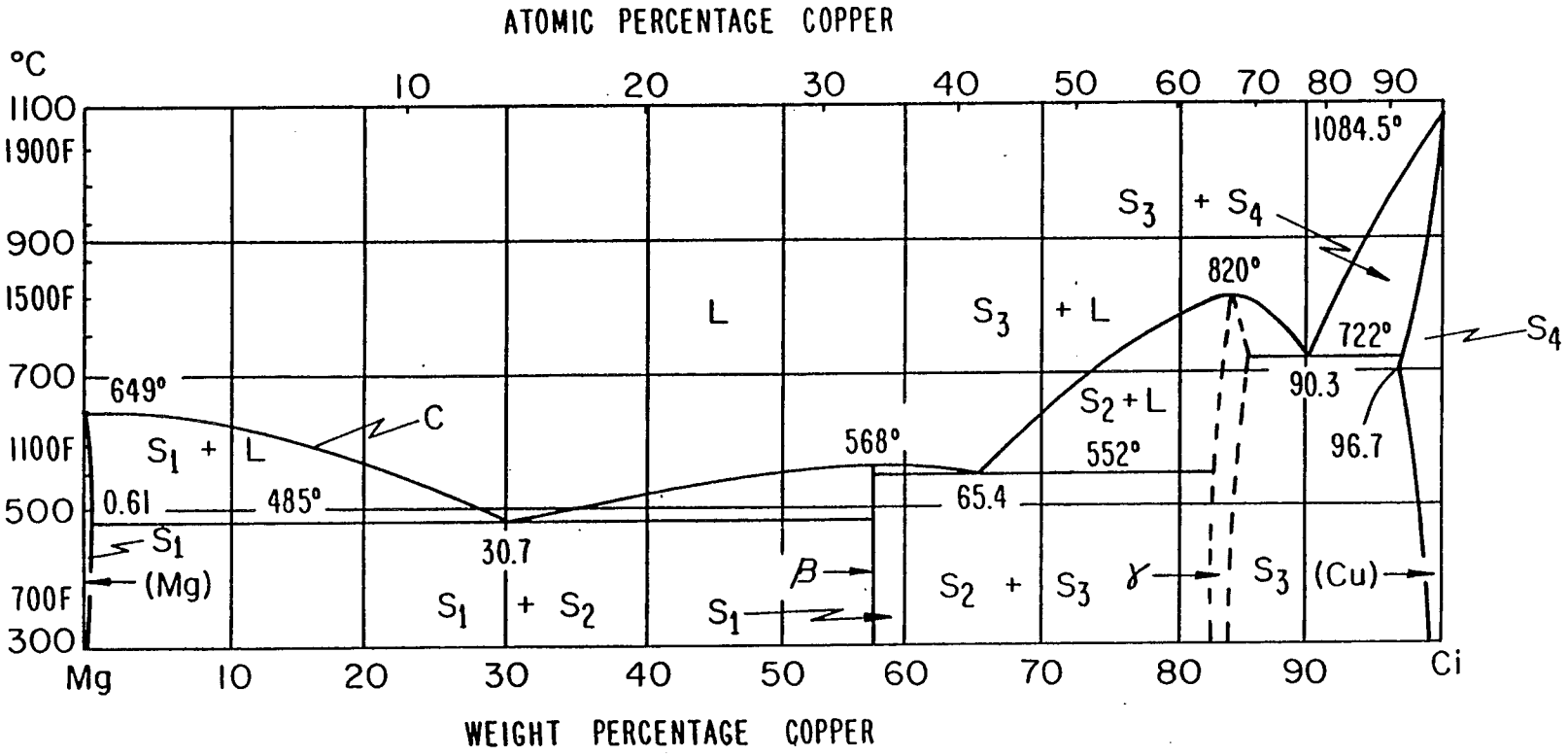

The phase diagram of FIG. 7 involving copper with magnesium fires shows that several solid phases are possible. In the region labeled $S_1$, a solid consisting almost entirely of magnesium with about 1% copper is present. In the region $S_4$, a solid with a somewhat variable composition but containing at least 96.7% copper is present. The solid phase $S_2$ has an approximate composition of 57% copper and 43% masgnesium. In the region $S_3$, a solid with a composition of about 82% copper and 18% magnesium occurs. Three regions are present containing mixtures of two different solids ($S_1+S_2$, $S_2+S_3$, and $S_3+S_4$), the mixture depending on the relative amounts of copper and magnesium. Likewise, several regions containing mixtures of a solid and liquid exist. For example, with approximately 10% copper, as the temperature is lowered, solid $S_1$ begins to appear in the liquid L at about 630 degrees Celsius. Similarly, at about 50% copper, the solid phase $S_2$ mixed with or supported on liquid L appears at temperatures below about 560 degrees Celsius. The curve marked C, which separates the region in which only liquid is present, has several minima at these approximate levels of copper: 30.7%, 65.4%, and 90.3%. These points represent eutectic compositions where low melting points occur. These eutectic points further represent compositions where particularly effective coating of the magnesium can be obtained.

Figure 8:
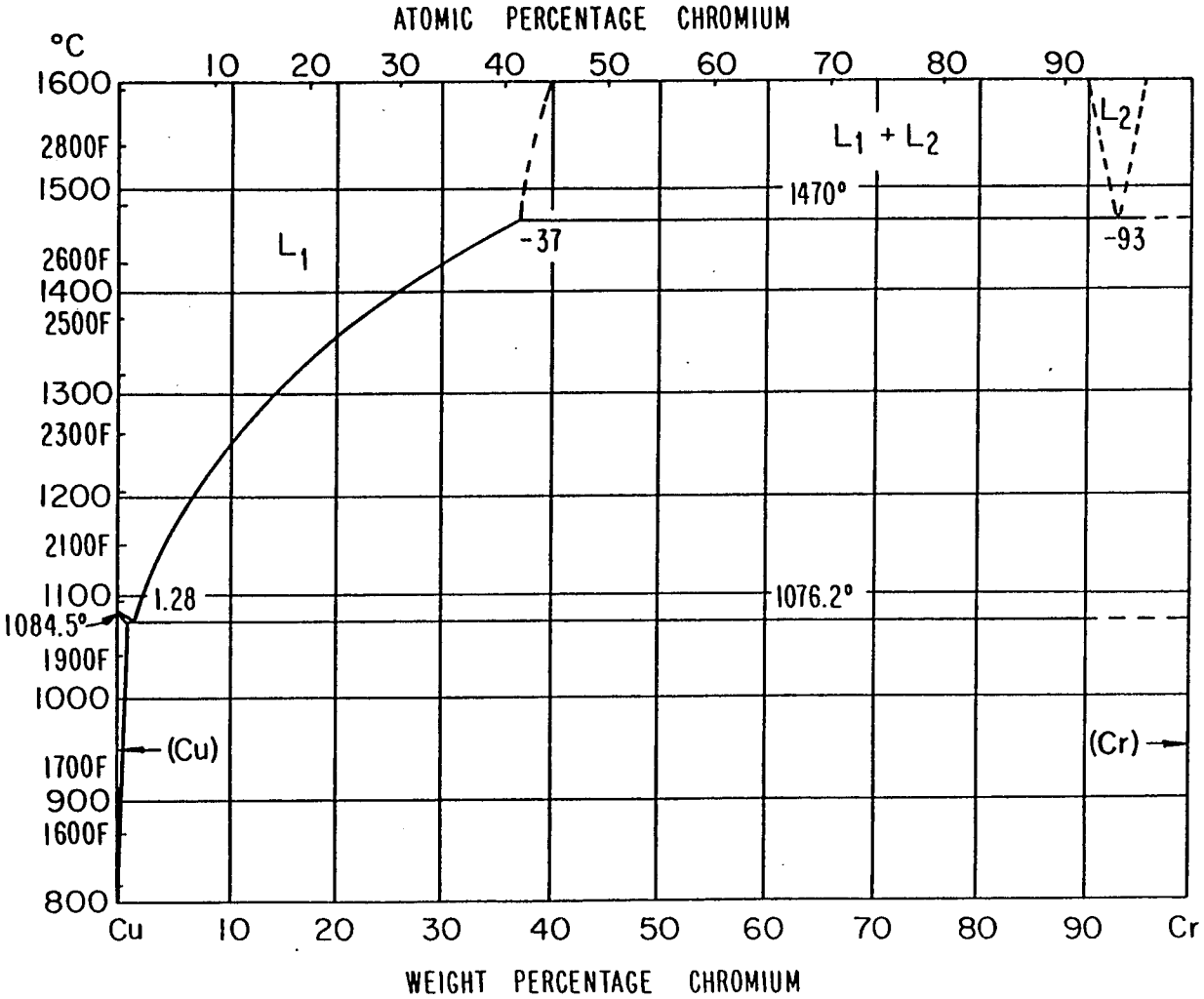

The phase diagram of FIG. 8 shows that during extinguishment of chromium fires with copper, two liquid phases $L_1$ and $L_2$ can exist simultaneously ($L_1+L_2$). A mixture of two solids, $S_1$ consisting primarily of copper, and $S_2$ consisting primarily of chromium, exists below about 1076.2 degrees Celsius over a very wide range of compostions. For chromium, extinguishment is achieved primarily by cooling and by formation of liquid copper over the chromium.

Figure 9:
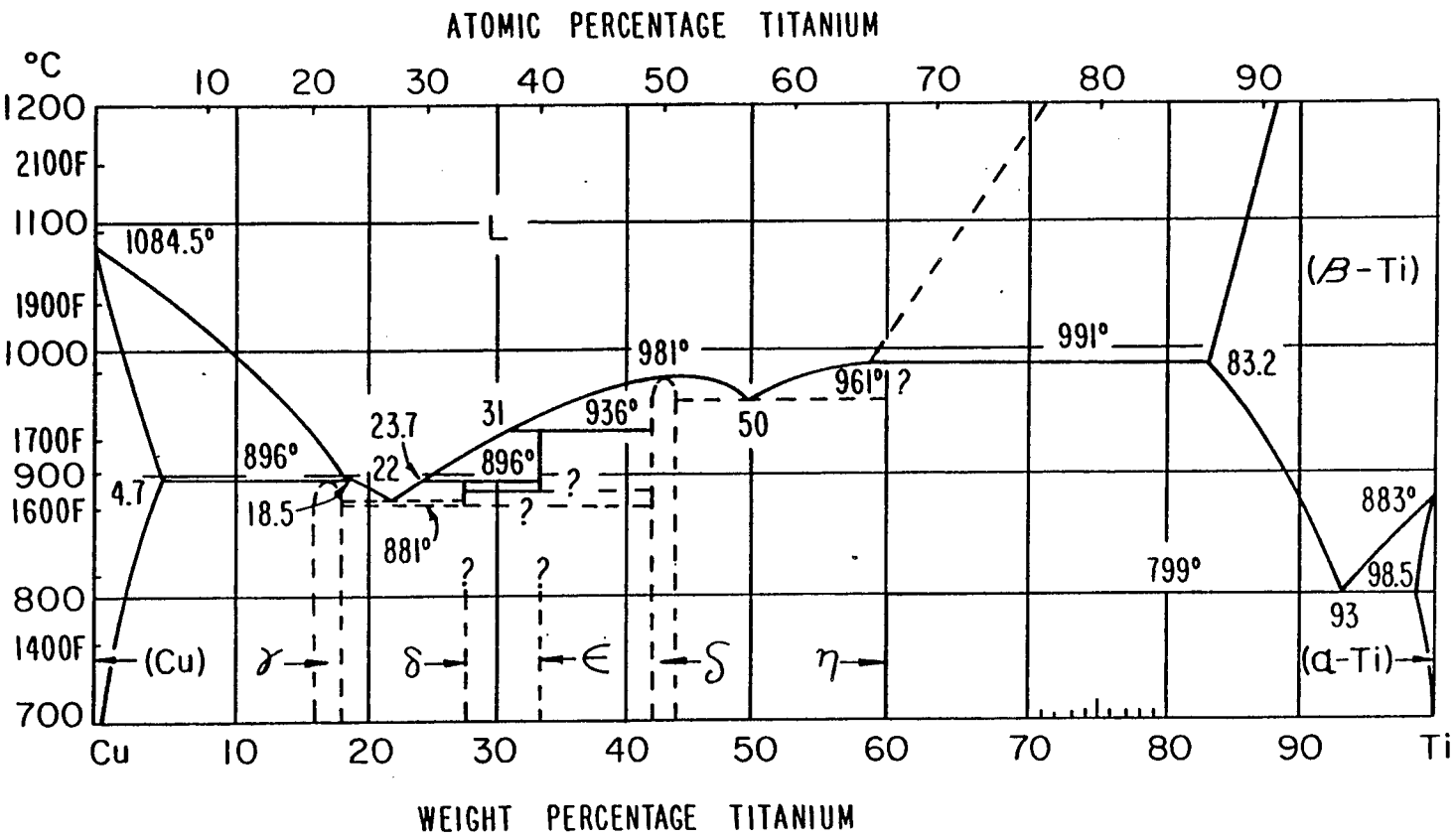
Figure 10:
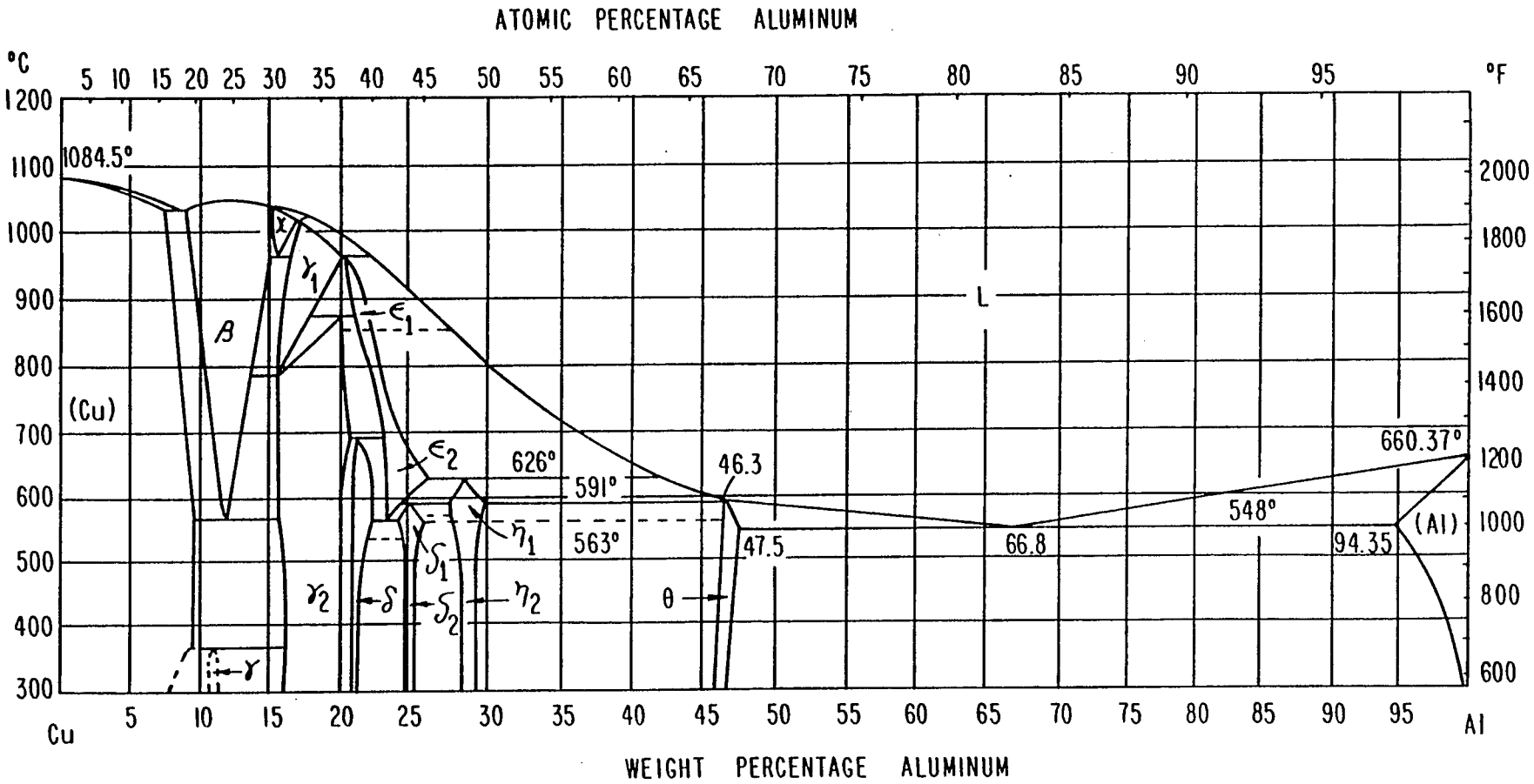

The phase diagrams of FIGS. 9 and 10 show the phases, alloys, and mixtures obtainable during the extinguishment of respectively, titanium and aluminum with copper. Again, the curves marked C give the temperatures at which solid coatings or layers can occur.

In accordance with an embodiment of the invention, the following results were obtained:

EXAMPLE 1

One ingot of lithium (approximately 2.3 pounds) was placed in the middle of a stainless steel 18-inch-square pan having a depth of 2 inches. At time zero, a propane burner was activated to ignite the lithium. At 3 minutes after time zero, the lithium was completely ignited, and the burner was turned off. At 4 minutes application of 35-mesh copper powder from a portable extinguisher pressurized to 195 psi with argon gas was initiated. The copper powder was applied in large bursts that covered the entire fire area. The fire was completely knocked down in 30 seconds following the initial application, and only a few hot spots remained where the molten lithium burned through the covering layer. At time 6 minutes, no more burning lithium was observed; however, 7 minutes after time zero, the coating burned through in the middle of the pan where the molten lithium was mounded up and the coating layer was the thinnest. More copper powder was applied. At time 8 minutes, the fire was totally extinguished and no subsequent burn-throughs were observed. Following extinguishment, the coating was deliberately disturbed and molten metal was found under the covering material, but the liquid did not reignite. At this time, the copper began developing a black ring that slowly grew to cover the extinguished metal. The lithium under the black crust was found to be solid and no longer molten. A total of 16 pounds of copper powder was used to achieve total extinguishment.

EXAMPLE 2

For a larger lithium fire, two ingots of lithium (approximately 4.6 pounds total) were placed in the center of a stainless steel 18-inch-square pan having a depth of 2 inches. At time zero, propane burners were turned on to ignite the lithium, and at time 4 minutes following time zero, the lithium was fully ignited and the burners were turned off. At 5 minutes, application of 35-mesh copper powder from a portable extinguisher pressurized to 195 psi with argon gas was initiated. The fire was controlled almost immediately, and only a few burning spots remained. More copper was applied to these spots. At time 9 minutes, the extinguisher was emptied of copper, and application of copper to the remaining hot spots was initiated with a second extinguisher. At time 11 minutes, no more lithium fire was observed; however at time 12 minutes from time zero, three more hot spots flared up. More copper was applied, and at time 13 minutes, the fire was completely extinguished. A total of 40.25 pounds of copper powder was used to completely extinguish the fire.

EXAMPLE 3

In a test using 20-mesh copper shot particles, two ingots of lithium (approximately 4.6 pounds total) were placed in the center of a stainless steel 18-inch-square pan having a depth of 2 inches. At time zero, propane burners were turned on to ignite the lithium, and at time 4 minutes following time zero, the lithium was fully ignited and the burners were turned off. At time 6 minutes, 20-mesh copper shot was applied to the burning lithium with a shovel. At time 8 minutes, the fire was under control with only a few spots exhibiting the white glow indicative of burning lithium. Addition of copper shot continued to give complete extinguishment at time 9 minutes. A total of 39.5 pounds of copper shot was used to completely extinguish the lithium fire.

EXAMPLE 4

To determine extinguishment characteristics for magnesium fire, 4 pounds of magnesium were weighed and were placed in the center of a stainless steel 18-inch-square pan having a depth of 2 inches. At time zero, propane burners were turned on to ignite the magnesium, and at time 6 minutes following time zero, the magnesium was fully ignited and the burners were turned off. At time 7 minutes, application of 35-mesh copper powder from a portable extinguisher pressurized to 195 psi with argon gas was initiated using long, sweeping strokes. At time 8 minutes, no more metal fire was observed; however, a small reignition occurred at one side of the pan supporting the burning metal. More copper was applied from the extinguisher, and at time 10 minutes, total extinguishment was achieved. A total of 21 pounds of copper powder was used to completely extinguish the magnesium fire.

EXAMPLE 5

Equipment to obtain a flowing, 3-dimensional fire was constructed from an aluminum container supported by a stainless steel pan elevated 18 inches above a larger pan. Both pans were made of 3/16-inch stainless steel. Seven ingots of lithium weighing a total of 16.5 pounds were loaded into the aluminum cone. Two burners were used to ignite the lithium, and the aluminum of the container also became ignited. One ten-gallon portable extinguisher, modified with a large diptube and ball valve, was filled with 35-mesh copper powder and was pressurized with 150 psi argon throughout the test. A wand and shovel nozzle was attached to a 1-inch hose from the extinguisher. Two portable hand-held extinguishers filled with 35-mesh copper powder and charged to 195 psi were also used. At time zero, the burners were ignited. At time 11 minutes after time zero, the container was tilted to allow liquid, burning lithium to flow into the bottom pan. At time 12 minutes, copper application from the ten-gallon extinguisher was initiated. Copper was applied to the bottom fire first. The bottom fire was controlled and essentially extinguished in 30 to 60 seconds. At time 13 minutes, copper was applied to the top fire. The lithium fire was rapidly suppressed; however, burning was still present around the underside of the aluminum container. At time 15 minutes, the ten-gallon extinguisher was emptied, and application from the hand-held extinguishers was initiated. At time 19 minutes, the fire was extinguished except for a small spot beneath the aluminum container. This spot was discovered and extinguished at time 25 minutes using copper powder discharged from a hand-held extinguisher. A total of 141 pounds of copper was used to completely extinguish this lithium fire.

EXAMPLE 6

A large lithium fire was obtained using lithium ingots weighing a total of 39.5 pounds placed in the center of a stainless steel pan, 28 inches wide by 40 inches long by 3 inches deep, resting on a containment floor. Two 10-gallon extinguishers, each modified with a large diptube and ball valve, were filled with 35-mesh copper powder and were pressurized with argon at 150 psi to 190 psi throughout the test. A wand and shovel nozzle was attached to the 1-inch hose from each extinguisher. Two hand-held extinguishers were also filled with 35-mesh copper powder and were charged to 195 psi. At time zero, two propane burners were turned on to ignite the lithium, and at time 12 minutes following time zero, the lithium was fully ignited and the burners were turned off. At time 12.5 minutes, copper powder was applied to the fire from one of the 10-gallon extinguishers. The fire was controlled within 5 seconds. At time 15 minutes, the fire was essentially extinguished with only a few spots exhibiting the white glow indicative of burning lithium. At time 16.5 minutes, addition of copper powder from the first-used 10-gallon extinguisher was continued to suppress small spots of continued combustion. At time 18.5 minutes, the first 10-gallon extinguisher was emptied and application from a hand-held extinguisher was initiated. At time 19.5 minutes, some molten lithium flowed out of the containment pan and onto the containment floor, where it continued to burn. More copper was applied to this fire from the hand-held extinguisher. At time 20.5 minutes, the fire on the containment floor was extinguished, and the fire in the containment pan was about 99% extinguished. Only a few minor burning spots remained. At time 22 minutes, the fire started to burn back slightly on the side of the containment pan. The second 10-gallon extinguisher was used to extinguish this fire. At time 24 minutes, the last burning spot was extinguished; however at time 25 minutes, a small spot of fire flared up on the side of the containment pan. More copper was applied from the second 10-gallon extinguisher and the spot was extinguished at time 25.5 minutes. At time 28 minutes, a spot flared up in the middle of the containment pan. More copper was applied from a hand-held extinguisher to completely extinguish the lithium fire at time 30 minutes. A total of 220 pounds of copper powder was used in this test to extinguish the lithium fire.

The foregoing describes the invention by way of examples and not by way of limitations.

What is claimed is:

1. A method of extinguishing the fire of a burning metallic body comprising the step of bringing into intimate physical contact with at least some portions of said body a substance containing a substantial amount of elemental copper whereby, upon said contact, the body and the elemental copper in said substance combine to form a mixture which acts as an adherent oxygen barrier.

2. The method of claim 1 wherein said substance further includes materials which improve the deliverability of the copper and have essentially negligible effect on the burning of the metallic body and the extinguishment thereof.

3. The method of claim 1 wherein said metallic body comprises a metal selected from the group consisting of the alkali metals, alkaline earth metals, magnesium, titanium, aluminum, and chromium.

4. The method of claim 3 wherein said metallic body further includes a salt of a metal selected from said group.

5. The method of claim 1 wherein said metallic body includes carbon.

6. The method of claim 1 wherein said metallic body is primarily lithium.

7. The method of claim 6 wherein said metallic body further includes lithium salts mixed with the lithium.

8. The method of claim 2 wherein said substance is in the form of particles dispensable from a conventional gas powered fire extinguisher.

9. The method of claim 1 wherein the amount of copper in said substance is at least effective to extinguish the fire.

10. The method of extinguishing fire of a burning metal selected from the group consisting of alkali metals, alkaline earth metals, carbon, aluminum, magnesium, chromium, and titanium, comprising:

a. providing a fire-extinguishing composition containing copper in an amount effective to extinguish the fire, and b. contacting at least a portion of the burning metal with the fire-extinguishing substance.

11. The method of claim 10 wherein the burning metal is combined with burning carbon.

12. The method of claim 10 in which at least a portion of the fire-extinguishing composition combines with the burning metal to form an adherent oxygen barrier.

13. The method of claim 10 in which the copper is in particulate form for dispensing from a gas powered fire extinguisher.

14. The method of claim 10 in which the fire-extinguishing composition contains at least effective to extinguish the fire.

15. The method of extinguishing a metal fire comprising contacting the metal fire with an effective amount of elemental copper.

16. The method of claim 15 in which at least a portion of the elemental copper combines with the burning metal to form an adherent oxygen barrier.

17. The method of claim 15 in which the elemental copper is in particulate form for dispensing from a gas powered fire extinguisher.

18. The method of claim 17 in which the material dispensed from the fire extinguisher contains at least 80% copper by weight.

19. An extinguishant for a burning metallic mass comprising:

a. a plurality of particulate bodies each containing a substantial amount of copper by weight and b. a thin film of electrically insulating material on each of said bodies, said film comprising material which disintegrates upon exposure to fire.

20. The extinguishant of claim 19 wherein said amount of copper is at least approximately 40% by weight.

21. The extinguishant of claim 19 wherein said amount of copper is at least approximately 80% by weight.

22. The extinguishant of claim 19 wherein said amount of copper is at least approximately 95% by weight.

23. The extinguishant of claim 19 wherein each of said bodies is round and of a size whereby the bodies may be dispensed from a conventional, gas powered fire extinguisher.

24. The extinguishant of claim 19 wherein said thin film is a polymer having slippery characteristics to facilitate dispensing from the fire extinguisher.

25. A device for extinguishing the fire of a burning metal body comprising:

a. a container having a body portion for storage of a charge of extinguishant material and a dispensing portion for directing the extinguishant material onto the fire, and b. a charge of extinguishant material stored in the body portion and including a substantial amount by weight of copper in a form capable of being dispensed through the dispensing portion.

26. The device of claim 25 wherein the amount of copper in the charge is at least effective to extinguish the fire.

27. A metal fire extinguishing composition comprising dispersible elemental copper and a carrier.

28. The composition of claim 27 in which the copper is in particulate form for dispensing from a gas powered fire extinguisher.

29. The method of extinguishing the fire of a burning metallic body comprising the step of bringing into intimate physical contact with at least some portions of said body a substance containing a substantial amount of copper whereby, upon said contact, the body and the copper in said substance combine to form a mixture which acts as an adherent oxygen barrier, said substance include materials selected from the group consisting of graphite, metal stearates, and tri-calcium phosphate which improve the deliverability of the copper and have essentially negligible effect on the burning of the metal body and the extinguishment thereof.

30. The method of extinguishing the fire of a burning metallic body comprising the step of bringing into intimate physical contact with at least some portions of said body a substance containing a substantial amount of copper whereby, upon said contact, the body and the copper in said substance combine to form a mixture which acts as an adherent oxygen barrier, said substance being in the form of a flat, thin sheet.

31. The method of claim 30 wherein the substance further includes materials which improve the deliverability of the copper and have essentially negligible effect on the burning of the metallic body and the extinguishment thereof.

32. The method of extinguishing fire of a burning metal selected from the group consisting of alkali metals, rare earth metals, carbon, aluminum, magnesium, chromium, and titanium comprising:

a. providing a fire-extinguishing composition containing copper in an amount effective to extinguish the fire, said copper being in particulate form dispensable from a gas powered fire extinguisher and coated with an electrically insulating material; and b. contacting at least a portion of the burning metal with the fire-extinguishing composition.

33. The method of claim 32 in which the electrically insulating material has slippery surface characteristics to facilitate dispensing from a fire extinguisher.

34. The method of extinguishing a metal fire comprising contacting the metal fire with an effective amount of copper in particulate form dispensable from a gas powered fire extinguisher and coated with electrically insulating material.

35. The method of claim 34 in which the electrically insulating material has slippery surface properties to facilitate dispensing from the fire extinguisher.

36. A device for extinguishing the fire of a burning metal body comprising:

a. a container having a body portion for storage of a charge of extinguishant material and a dispensing portion for directing the extinguishant material onto the fire, and b. a charge of extinguishant material stored in the body portion and including a substantial amount by weight of copper in particulate form coated with electrically insulating material and capable of being dispensed through the dispensing portion.

37. A metal fire extinguishing composition comprising dispersible copper and a carrier, said copper being in particulate form coated with electrically insulating material for dispensing from a gas powered fire extinguisher.

38. The composition of claim 37 in which the electrically insulating material has slippery surface properties to facilitate dispensing from the fire extinguisher.

* * * * *